United States Patent [19]

Sowders

[11] 4,076,116

[45] Feb. 28, 1978

[54] KA-BOB DISPLAY

[76] Inventor: Roger E. Sowders, 7322 Elm Court, Wichita, Kans. 67206

[21] Appl. No.: 601,527

[22] Filed: Aug. 4, 1975

[51] Int. Cl.[2] ..... B65D 1/34

[52] U.S. Cl. ..... 206/45.19; 99/419; 206/382; 206/486; 206/562; 206/564

[58] Field of Search ..... 206/72, 382, 562, 563, 206/564, 565, 486, 45.19; 99/419, 442; 312/126

[56] References Cited

U.S. PATENT DOCUMENTS

| | | | |
|---|---|---|---|
| 1,896,313 | 2/1933 | Hubbell et al. | 99/442 |
| 2,935,206 | 5/1960 | Smith | 206/72 |
| 2,969,011 | 1/1961 | Sperl | 99/419 |
| 3,300,055 | 1/1967 | Rottr | 206/72 |
| 3,400,812 | 9/1968 | Snow | 206/565 |
| 3,494,201 | 2/1970 | Roach | 206/72 |
| 3,532,221 | 10/1970 | Kaluhiokalani et al. | 206/72 |
| 3,643,812 | 2/1972 | Mander et al. | 206/72 |
| 3,712,465 | 1/1973 | Deuschle | 206/72 |
| 3,768,639 | 10/1973 | Dogliotti | 206/564 |
| 3,807,954 | 4/1974 | McDonald | 206/72 |
| 3,828,967 | 8/1974 | Grabhorn et al. | 206/821 |

*Primary Examiner*—George E. Lowrance
*Assistant Examiner*—Joseph M. Moy
*Attorney, Agent, or Firm*—John H. Widdowson; Edwin H. Crabtree

[57] ABSTRACT

A display device mountable in a refrigerated meat display case to display ka-bob skewers having chunks of meat and food items mounted thereon. A holder having a rectangular form has a plurality of spaced apertures therein opening to the holder's top. The apertures are angularly inclined toward one end of the holder. The holder is mountable in a locked relation in a tray.

1 Claim, 4 Drawing Figures

KA-BOB DISPLAY

BACKGROUND OF THE INVENTION

This invention is related to food product display devices for display cases. More particularly, this invention is related to a ka-bob meat display device for a refrigerated meat display case.

In prior art numerous types of meat display devices are known, however, they primarily consist of trays some of which have supports therein and some of which do not to receive and display slices or large chunks of meat. No device is known in the prior art specifically for displaying ka-bobs in a meat display case or displaying them for other purposes. In many butcher shops ka-bobs are displayed by merely laying the skewers on their side in a tray after they have been loaded with meat and other items, such as onions, pickles, tomatoes, etc. Becuase the separate chunks of meat on these devices touch one another they tend to discolor rather rapidly when placed on display. Trays are known in the art which function solely to support a ka-bob skewer for flaming and serving of the item at a meal. While these devices will support a loaded skewer they only support one or maybe two, therefore they are not well suited for use in a butcher shop display.

SUMMARY OF THE INVENTION

In an embodiment a meat display holder includes a tray having upturned edge portions around its bottom and a holder mounted in the tray having a plurality of apertures which are positioned in a spaced relation and inclined in one direction to receive and mount a plurality of skewers. The holder has a means to lock it in a fixed position on the tray. The holder is constructed so that it can in use be placed in a refrigerated meat display case and after a plurality of meat laden ka-bob skewers have been mounted in the plurality of apertures. The holder has apertures arranged in an inclined relation to the plane of the holder so the skewers are supported in a nearly vertical position when the display device is positioned in a meat case that has an inclined bottom. Most conventional or typical meat cases have an inclined bottom tilting upward from the rear.

One object of this invention is to provide a meat display device overcoming the disadvantages of the aforementioned prior art devices and fulfilling a long felt need in the art.

Still, one object of this invention is to provide a ka-bob display device which has a plurality of apertures arranged in a spaced relation and in an inclined fashion to support ka-bob skewers such that products on adjacent skewers will not touch.

Still, another object of this invention is to provide a meat display device which has an elongated holder with a plurality of apertures for receiving and mounting ka-bob skewers wherein the holder being constructed so that it locks itself in a fixed position in an elongated tray of the type generally conventionally used in meat display cases.

Various other objects, advantages and features of the invention will become apparent to those skilled in the art from the following discussion, taken in conjunction with the accompanying drawings, in which:

Figure 1:
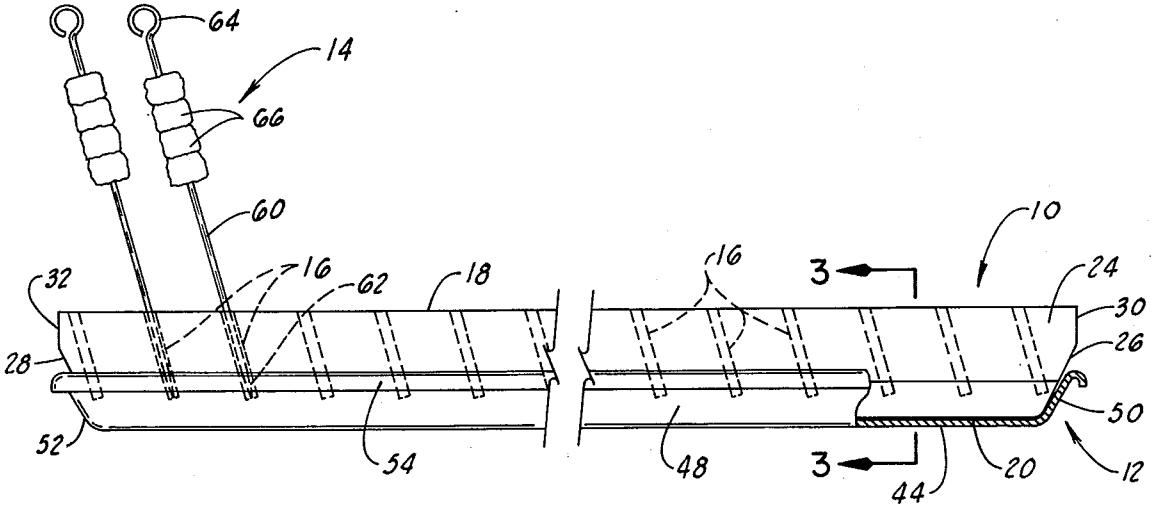
FIG. 1 is a shortened side elevation view of the display device of this invention with the inclined apertures shown in dashed lines, having a portion of the tray cut away for clarity, and showing a pair of product ladened ka-bob skewers positioned in adjacent apertures.

The following is a discussion and description of preferred specific embodiments of the ka-bob display device of this invention such being made with reference to the drawing whereupon the same reference numerals are used to indicate the same or similar parts and/or structure. It is to be understood that such discussion and description is not to unduly limit the scope of the invention.

DESCRIPTION OF PREFERRED EMBODIMENT

Referring to the drawing in detail and in particular to FIG. 1 the ka-bob holder of this invention is indicated generally at 10 as shown mounted in a tray 12 and having a pair of loaded ka-bob skewers 14 mounted thereon. The ka-bob holder 10 has a plurality of spaced apertures 16 therein which are angularly oriented relative to a plane defined by the holder and it has means on the side and end thereof to lock it in a fixed position in the tray 12.

Figure 2:
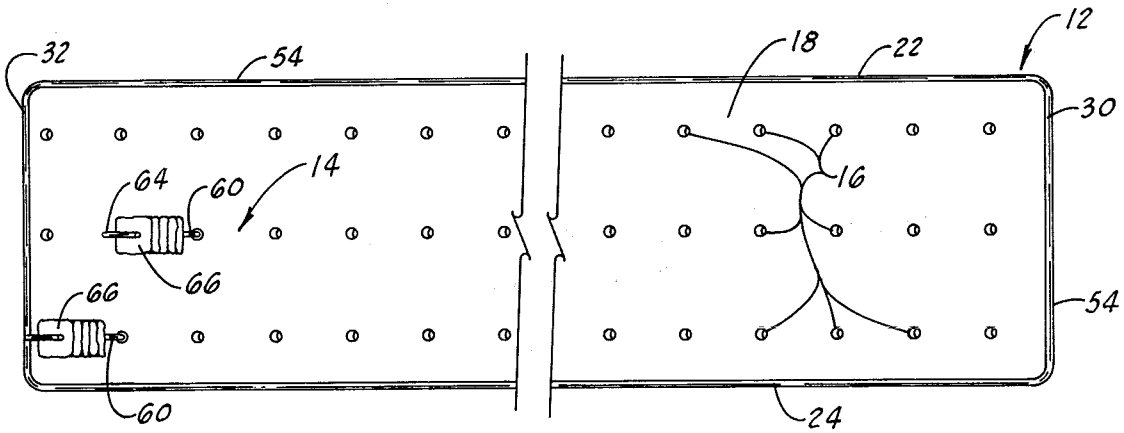
FIG. 2 is a shortened top plan view of the meat display device as shown in FIG. 1 with a pair of loaded ka-bob skewers positioned in adjacent apertures in one end of the holder.

Holder 10 can be formed in an elongated shape as shown on the drawing in order to fit into a standard size meat display case tray. It is to be noted that holder 10 can be constructed in a substantially square form if desired. Holder 10 has an essentially flat top 18 and flat bottom 20 with opposed elongated sides 22 and 24 and opposed ends. The opposed ends are inclined in the lower portion as indicated at 26 and 28. The ends are essentially upright in their upper portion as indicated at 30 and 32 on the ends 26 and 28, respectively. Upright sides 22 and 24 are champered on their lower outer corner portions as indicated at 34 and 36, respectively. Apertures 16 are inclined relative to top 18 and holder bottom 20 as shown in dashed lines in FIG. 1. The apertures are preferably arranged in a spaced relation to one another as shown in FIG. 2 wherein the apertures are arranged in rows. One row of apertures is located at each elongated edge portion of the ka-bob holder and the third row is centrally located generally along the longitudinal axis of the holder. The underneath side of ka-bob holder 10 is provided with a pair of recesses which are individually indicated at 38 and 40. Recesses 38 and 40 preferably extend the entire length of ka-bob holder 10. It is to be noted that recesses 38 and 40 are not necessary for construction of the ka-bob holder 10, however, they are desirable for reducing the weight of the unit when it is constructed of substantially dense materials, such as selected aluminum and stainless steel alloys.

Tray 12 has an essentially flat bottom 44 with opposed upright sides 46 and 48, and opposed upwardly inclined ends 50 and 52. The upper portions of the sides and the ends of tray 12 are provided with a downwardly curled edge portion or rim 54. Tray ends 50 and 52 are smoothly curved at their lower corner portion and angularly inclined upwardly and outwardly relative to tray bottom 44. Tray ends 50 and 52 are substantially flat in portions thereof which are not at the corners. Tray sides 46 and 48 are substantially upright. A majority of currently manufactured meat display case trays have their sides fairly flat and outwardly and upwardly inclined relative to the bottom as can be seen from a close examination of FIG. 3.

Figure 3:
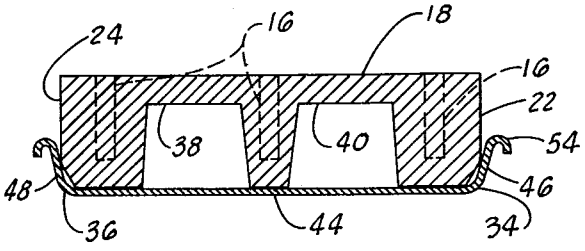
FIG. 3 is a cross sectional view of the holder and tray in mounted position with the view taken on line 3—3 of FIG. 1.
Figure 4:
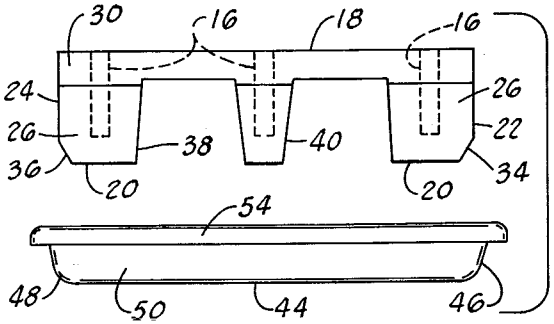
FIG. 4 is an exploded end elevation view of the holder and the tray with the holder shown in spaced position above the tray and the apertures in the holder shown in dashed lines.

Holder 10 mounts in tray 12 as shown in FIG. 1 and it is secured in place by the locking means. The locking means includes the sizing of the lower portion of holder 10 in its elongated direction and the shaping of the inclined end portions 26 and 28 to fit in a snug or firm nesting relation inside opposed ends 50 and 52 of tray 12 with the holder bottom 20 resting on tray bottom 44. The locking means also includes the lateral sizing of ka-bob holder 10 such that opposed sides 22 and 24 of the holder fit firmly or in a snug nesting relation inside opposed tray sides 46 and 48 with the champered portions of 34 and 36 of the holder spanning the lower corner portions of the sides of tray 12. The nested mounting relation of ka-bob holder 10 in tray 12 is an important feature of this invention because it firmly and positively retains ka-bob holder 10 in tray 12 when tray 12 is tilted with one end being substantially lower than the other. The importance of this feature is that it holds ka-bob holder 10 firmly in tray 12 when it is tilted as it is being placed in a meat display case and as it rests in a meat display case in a tiltedposition with one end being substantially lower than the other. In addition to securing the ka-bob holder 10 in tray 12 to avoid movement of the holder from tipping when one end is lower than the other the locking means also provides for retaining the holder due to tipping in the lateral direction by virtue of the snug fitting nesting relation of the sides of the holder in the tray. Preferably the lower corner portion of the juncture of holder bottom 20 and lower end portions 26 and 28 are rounded to fit inside the rounded interior lower corner portion of tray ends 50 and 52 where they join tray bottom 44. FIG. 3 shows the holder sides where the champered portions 34 and 36 span the trays' side corners and holder sides 22 and 24 contact the tray sides 46 and 48. Depending upon the angle of inclination of tray sides 46 and 48 this juncture point and possibly a portion of the tray sides will contact the holder sides.

FIG. 1 shows a pair of skewers 14 mounted in apertures 16. The skewers 14 are representative of typical skewers which can be used with the holder of this invention. The skewers are constructed individually with an elongated shank 60 having a pointed lower end portion 62 and looped upper end portion 64. These skewers are usually loaded with chunks of food products 66 such as meat or meat mixed with other items such as tomatoes, peppers, onions, etc. The spaced relation of apertures 16 is an important feature of this invention because it maintains the products which are being displayed in a spaced relation so they do not touch for nominally sized chunks of articles. Obviously the items which are being displayed must be substantially uniformly sized in relation to the spaced relation of the apertures so that they do not touch. In the case of displaying meat the spaced separated relation is an important feature to prevent discoloration of the separate chunks of meat because they will discolor if they come into contact with each other.

FIG. 2 shows a top plan view of the ka-bob holder 10 having a pair of product ladened skewers mounted on the left hand end portion thereof. It is to be noted the items which are displayed are in a substantial spaced relation to each other. For a nominally sized meat display tray of approximately 5 inches in width it has been in practice found convenient to place three rows of apertures in a ka-bob holder constructed to be mounted in the tray. By selectively placing the rows of apertures approximately as shown in FIG. 2 it is possible to arrange them such that chunks of meat and other products with approximately a diameter in the range of 1 inch to 1½ inches can be mounted on skewers in the holder so the products do not come into contact with each other. In this particular selection of apertures it is to be noted that they must be positioned in lateral spacing such that products on the outer rows of apertures will not come into contact with similar products on outer rows of apertures in adjacent holders.

In the manufacture of the ka-bob holder of this invention, it is obvious that it can be easily constructed to achieve the end product. Preferably the ka-bob holder of this invention is cast, forged, or otherwise formed from an aluminum or stainless steel alloy because these materials are currently and commonly accepted in the butchering art for use in meat display cases. It is to be noted that the ka-bob holder can be porcelainized or otherwise coated with a suitable, cleanable and sanitizable coating without departing from the scope of the invention and to make the holders more attractive for use. The ka-bob holder of this invention can be manufactured in sizes to fit commonly available trays currently used in butcher shops or the like or it can be constructed with specially sized and designed trays if desired.

In the use and operation of the ka-bob holder of this invention it is seen that same provides a simple and efficient skewer support apparatus for displaying meat and other food products on skewers in an attractive fashion. The ka-bob holder is specifically adapted for use in a refrigerated meat display case to display chunks of meat on skewers. In actual use the of ka-bob holder of this invention it has been used to display chunks of meat along with other items such as, peppers, onions, potatoes, and other food items which are commonly cooked on food skewers.

As will become apparent from the foregoing description of the applicant's ka-bob holder a relatively simple and inexpensive means have been provided to support ka-bob skewers for display. The ka-bob holder is economical to manufacture, simple to use, and can be constructed of materials which will enable it to be used in a butcher shop, wherein cleanliness and sanitary conditions are an upmost requirement.

While the invention has been described in conjunction with preferred specific embodiments thereof, it will be understood that this description is intended to illustrate and not limit the scope of the invention, which is defined by the following claims.

I claim:

1. A meat display holder, the holder comprising:

a tray having an open top portion, a flat bottom portion, side portions, and end portions, the side portions and end portions of said tray angled upwardly and outwardly from the flat bottom portion of said tray;

a holder mounted in said tray, said holder having a flat top portion, a flat bottom portion disposed on top of the bottom portion of said tray, side portions, and end portions, the side portions and end portions of said holder angled upwardly and outwardly and received in a snug fit against the angled side portions and end portions of said tray when the holder is mounted thereon, said holder extending upwardly from the open top portion of said tray;

a plurality of apertures in the top portion of said holder, said apertures arranged in rows in the top portion of said holder and parallel to the length of said holder, said apertures inclined toward one of the end portions of said holder; and a plurality of upwardly extending recesses disposed along the length of said holder and in the bottom portion thereof, said recesses parallel and adjacent the rows of said apertures along the length of said holder;

the display holder being constructed and adapted in use for placing in a refrigerated meat display case or the like and having food product ladened ka-bob skewers slidably received in said plurality of apertures.

* * * * *